US011745985B2

(12) United States Patent
Rose

(10) Patent No.: US 11,745,985 B2
(45) Date of Patent: Sep. 5, 2023

(54) FUEL TANK LIFTING SYSTEM

(71) Applicant: Michael S. Rose, New Bern, NC (US)

(72) Inventor: Michael S. Rose, New Bern, NC (US)

( * ) Notice: Subject to any disclaimer, the term of this patent is extended or adjusted under 35 U.S.C. 154(b) by 0 days.

(21) Appl. No.: 17/840,158

(22) Filed: Jun. 14, 2022

(65) Prior Publication Data

US 2022/0411230 A1 Dec. 29, 2022

Related U.S. Application Data

(60) Provisional application No. 63/213,832, filed on Jun. 23, 2021.

(51) Int. Cl.
*B66C 1/10* (2006.01)

(52) U.S. Cl.
CPC ..... *B66C 1/10* (2013.01)

(58) Field of Classification Search
CPC .. B66C 1/10; B66C 1/36; B66C 1/105; B66C 1/54
USPC ..... 294/82.1, 82.13, 93, 94, 95, 96, 97
See application file for complete search history.

(56) References Cited

U.S. PATENT DOCUMENTS 2,327,005 A * 8/1943 Babcock ..... B66C 1/625 294/90
2,809,070 A * 10/1957 Nelson ..... B66C 1/54 294/93
3,206,243 A * 9/1965 Miles ..... B66C 1/66 294/93
3,264,027 A * 8/1966 Luther ..... D01H 17/00 294/90
3,352,591 A * 11/1967 Casey ..... B66C 1/625 294/90
3,401,973 A * 9/1968 Marshall ..... B66C 1/54 294/93
4,669,618 A * 6/1987 Brand ..... B66C 1/34 294/215
5,161,845 A * 11/1992 Carpenter, Jr. ..... B66C 1/625 294/90
5,306,062 A * 4/1994 Dodge ..... B66C 1/62 294/93
5,352,056 A * 10/1994 Chandler ..... F16G 15/08 294/82.1
6,592,320 B1 * 7/2003 Adams ..... B66C 1/62 294/110.1
8,201,867 B2 * 6/2012 Thomeczek ..... B66C 1/66 294/215

(Continued)

*Primary Examiner* — Paul T Chin
(74) *Attorney, Agent, or Firm* — NK Patent Law

(57) ABSTRACT

A lifting apparatus includes: a plate having multiple arms extending outward from a center thereof, each arm for engaging a respective portion of a support ring of a fuel tank; and multiple clips, each rotatably mounted on a respective arm. The clips rotate from an unlatched position to a latched position to secure the plate to the support ring of the fuel tank. A swivel device is rotatably mounted on the plate. Each arm has a ledge lowered from an upper surface of the plate for contact engagement with the bottom side of the support ring. Each ledge is sunken or lowered from the upper surface of the plate by a respective shoulder, such that the ledges and shoulders register and stabilize engagement of the plate with the support ring. The clips snap into the latched and unlatched positions and are automatically maintained there until rotated intentionally by hand by a user.

11 Claims, 6 Drawing Sheets

(56) References Cited

U.S. PATENT DOCUMENTS 8,764,083 B2 * 7/2014 Beider ..... B66C 1/108
294/81.61

* cited by examiner

FUEL TANK LIFTING SYSTEM

RELATED APPLICATIONS

This application claims priority to U.S. Provisional Patent Application No. 63/213,832, titled "FUEL TANK LIFTING SYSTEM," and filed on Jun. 23, 2021, the entire content of which is incorporated by reference herein.

TECHNICAL FIELD

The present invention generally relates to aircraft fuel tank lifting mechanisms and more specifically relates to a rigging adapter which efficiently and safely lifts and maneuvers a fuel tank for cleaning and repair.

BACKGROUND

Aircraft utilize onboard collapsible and flexible storage containers that provide a storage for fuel. These fuel tanks offer a high degree of protection to ensure the contents do not encounter air or the outside environment.

During servicing and maintenance, the fuel tanks are often removed from the aircraft. Each tank is typically extracted manually from aircraft by maintenance personnel. Once removed from the aircraft the fuel tank is placed in a crate for transport. Each fuel tank includes a support ring, typically termed an access panel, by which rigging gear can be attached to the fuel tank. As tanks can be heavy, unassisted lifting can result in an increase to the probability of damage to the fuel tank and injury to the maintenance personnel. Further, the process of crating and uncrating may require multiple laborers and an associated increase in the use of labor time resources needed to complete the task.

Improvements are needed for the lifting and handling of fuel tanks.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

A lifting apparatus includes: a plate having multiple arms extending outward from a center thereof, each arm for engaging a respective portion of a support ring of a fuel tank; and multiple clips, each rotatably mounted on a respective arm, wherein, the clips are each rotatable from an unlatched position to a latched position to secure the plate to the support ring of the fuel tank.

A swivel device may be rotatably mounted on the plate.

A link may be pivotably mounted on the swivel device.

Each arm may define, at a distal end thereof, a ledge lowered from an upper surface of the plate, the ledge for contact engagement with a respective area of a bottom side of the support ring.

Each ledge may be sunken or lowered from the upper surface of the plate by a respective shoulder, such that the ledges and shoulders register and stabilize engagement of the plate with the support ring.

In at least one example, in full engagement with the support ring, each ledge contacts the bottom side of the support ring, and each shoulder abuts or approximately abuts an inner periphery of the support ring.

Each clip may snap into the latched and unlatched positions and be maintained there by a respective spring plunger until rotated intentionally by hand by a user.

The plate may have cutouts along peripheral portions between the extended arms permitting the plate to be manipulated into engagement with the support ring.

The above summary is to be understood as cumulative and inclusive. The above-described embodiments and features are combined in various combinations in whole or in part in one or more other embodiments.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
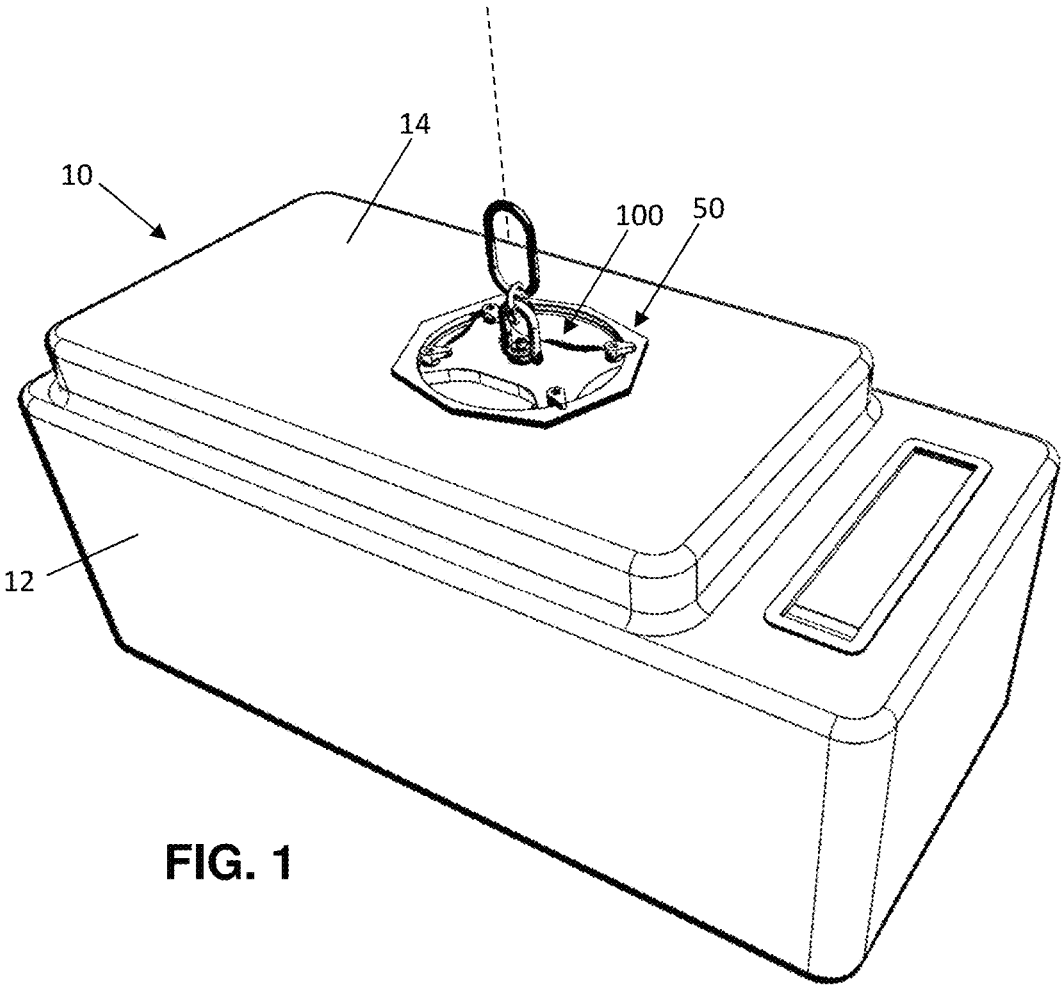
FIG. 1 is a perspective view of a fuel tank lifted by an improved lifting apparatus, according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described. It is contemplated that the use of the term "tank" herein also encompasses structures referred to as rigid removable and bladders. Indeed, the use of the term "fuel tank" herein also encompasses structures commonly referred to as "fuel bladders."

In general, the embodiments described herein relate to a fuel tank lifting apparatus provided to lift and maneuver a fuel tank cell safely and efficiently. The apparatus, when used in conjunction with a crane, jack, or other lift apparatus, alleviates the need for user exertion when lifting and manipulation the fuel tank thereby reducing the chances of damage to the tank and injury to a user, such as aircraft maintenance technician or other personnel.

FIG. 1 is provided for illustration of an exemplary use of an improved lifting apparatus 100, according to at least one embodiment. An exemplary fuel tank 10 is shown as a having a container 12, which may be flexible bladder that contains, for example, aircraft fuel. The top side 14 of the fuel tank is connected to a support ring 50, by which the lifting apparatus 100 is removably coupled to the tank 14 for lifting and moving purposes. The support ring 50 remains with the tank 10 as the lifting apparatus 100 is coupled and uncoupled from the tank 50.

Figure 2:
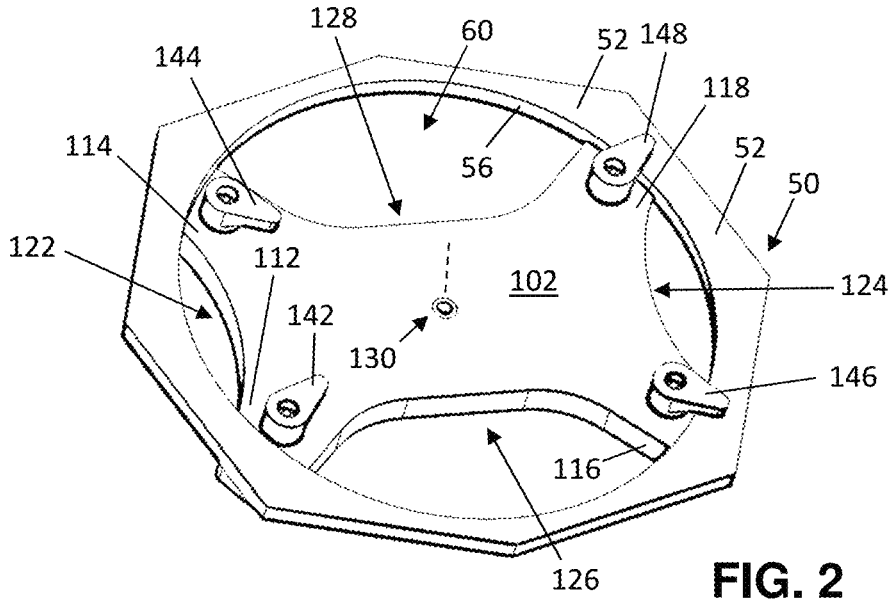
FIG. 2 is a top perspective view of the plate and clips of the apparatus and the support ring of the tank.
Figure 3:
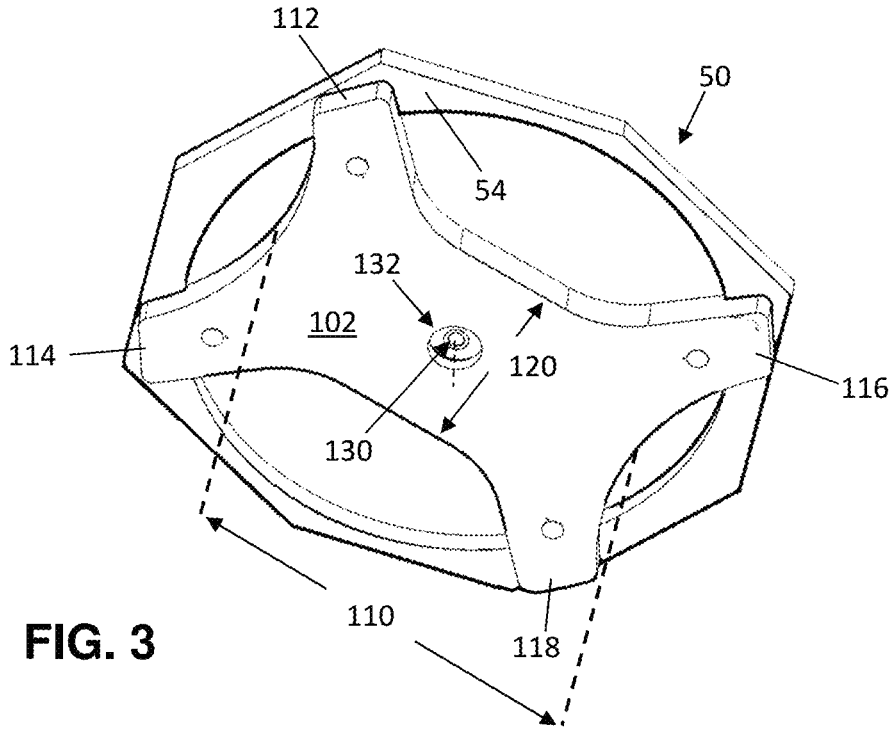
FIG. 3 is bottom perspective of view the components of FIG. 2.

The lifting apparatus in part and support ring 50 are shown in FIG. 2 without the container. The lifting apparatus 100 includes a plate 102 having a central portion and arms 112, 114, 116, and 118 extending therefrom. The top of the plate 102 is shown in FIG. 2, and the bottom is shown in FIG. 3. Top and bottom as used herein are relative terms used with respect to the expected use of the lifting apparatus. The plate 102 has a central hole 130, passing therethrough, for connecting hoisting elements to the plate 102.

The central portion has a length 110 (FIG. 3) defined between cutouts 122 and 124 (FIG. 2), and a lesser width 120 defined between cutouts 126 and 128. The cutouts defined between the arms permit the plate 102 to be manipulated into engagement with the support ring 50. The support ring 50 has a top side 52 (FIG. 2), a bottom side 54 (FIG. 3), and an inner periphery 56 (FIG. 2) defining an opening 60. To couple the lifting apparatus 100 to the support ring 50, the plate 102 is passed from the top side 52 to the bottom side 54 though the opening 60 by manipulation of the plate 102. The cutouts 122-128 accommodate the manipulation of the plate through the opening. Once the plate 102 is passed through, the plate 102 is settled into engagement with the support ring 50 by contact engagement of the arms 112-118 with respective areas of the bottom side 54 of the support ring 50.

Each arm 112-118 carries a respective clip 142-148 that is rotatable from an unlatched position (see clips 142 and 144 in FIG. 2), to a latched position (see clips 146 and 148). In the unlatched positions, the clips extend generally inward toward the center of the plate 102. In their latched positions, the clips extend generally outward from the center of the plate 102, each overhanging an outer portion of the respective arm, thereby trapping the support ring 50 between the arms and clips. Once the plate 102 is settled into engagement with the support ring 50 by contact engagement of the arms 112-118 with respective areas of the bottom side 54 of the support ring 50, the clips 142-148 are rotated by hand to their latched positions to securely couple the lifting apparatus 100 to the support ring 50.

Figure 4:
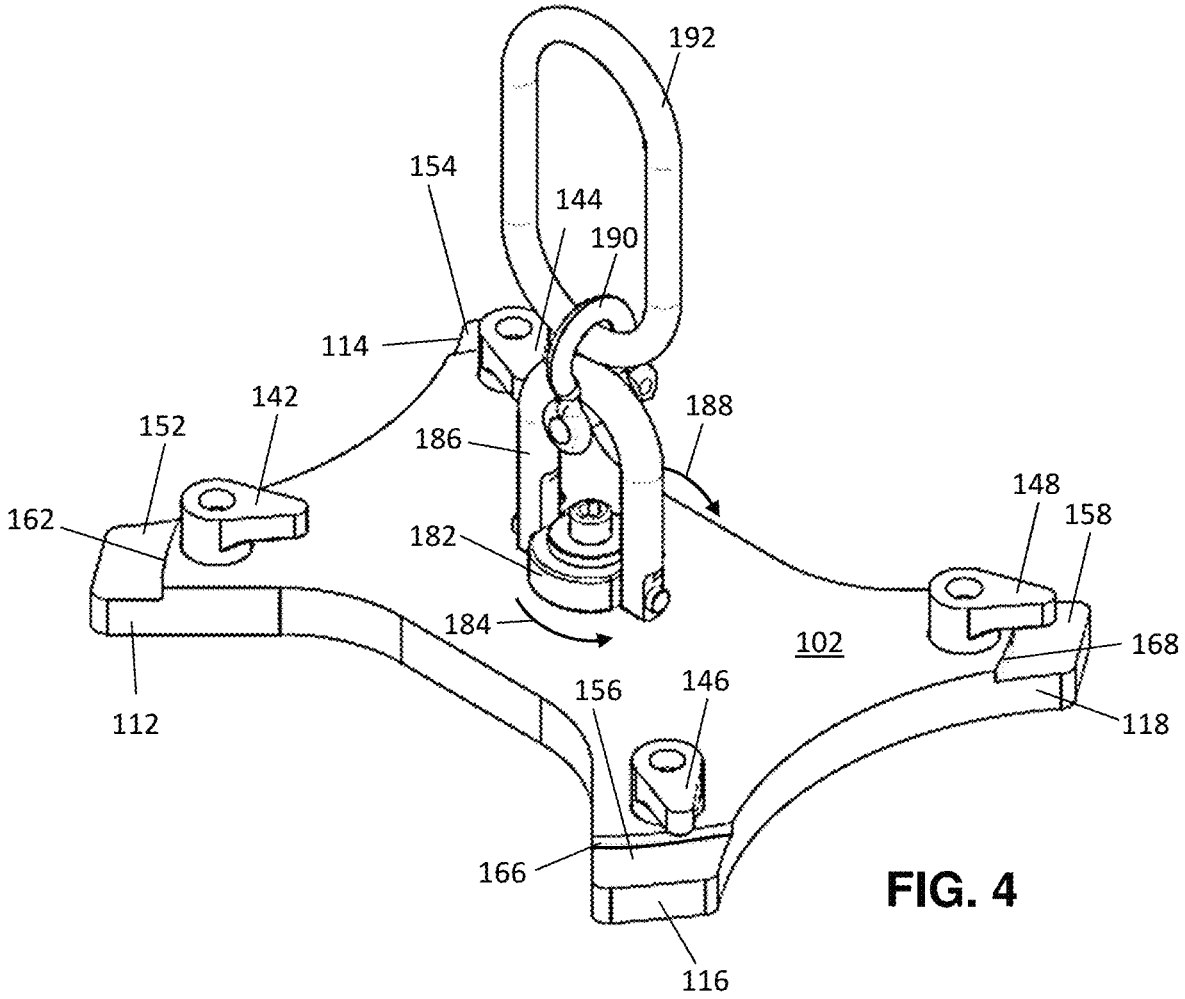
FIG. 4 is a perspective view of the lifting apparatus of FIG. 1 without the fuel tank.

As shown in FIG. 4, each arm 112-118 has a respective top side ledge 152-158, which is sunken or lowered from the top side of the plate 102 by a respective shoulder 162-168. The ledges and shoulders register and stabilize engagement of the plate with the support ring 50. In full engagement with the support ring 50, each ledge contacts the bottom side 54 of the support ring 50, and each shoulder abuts or approximately abuts the inner periphery 56 (FIG. 2) of the support ring 50. The shoulders, in cooperation with the ledges, thus keep the plate 102 centered with respect to the opening 60.

Figure 8:
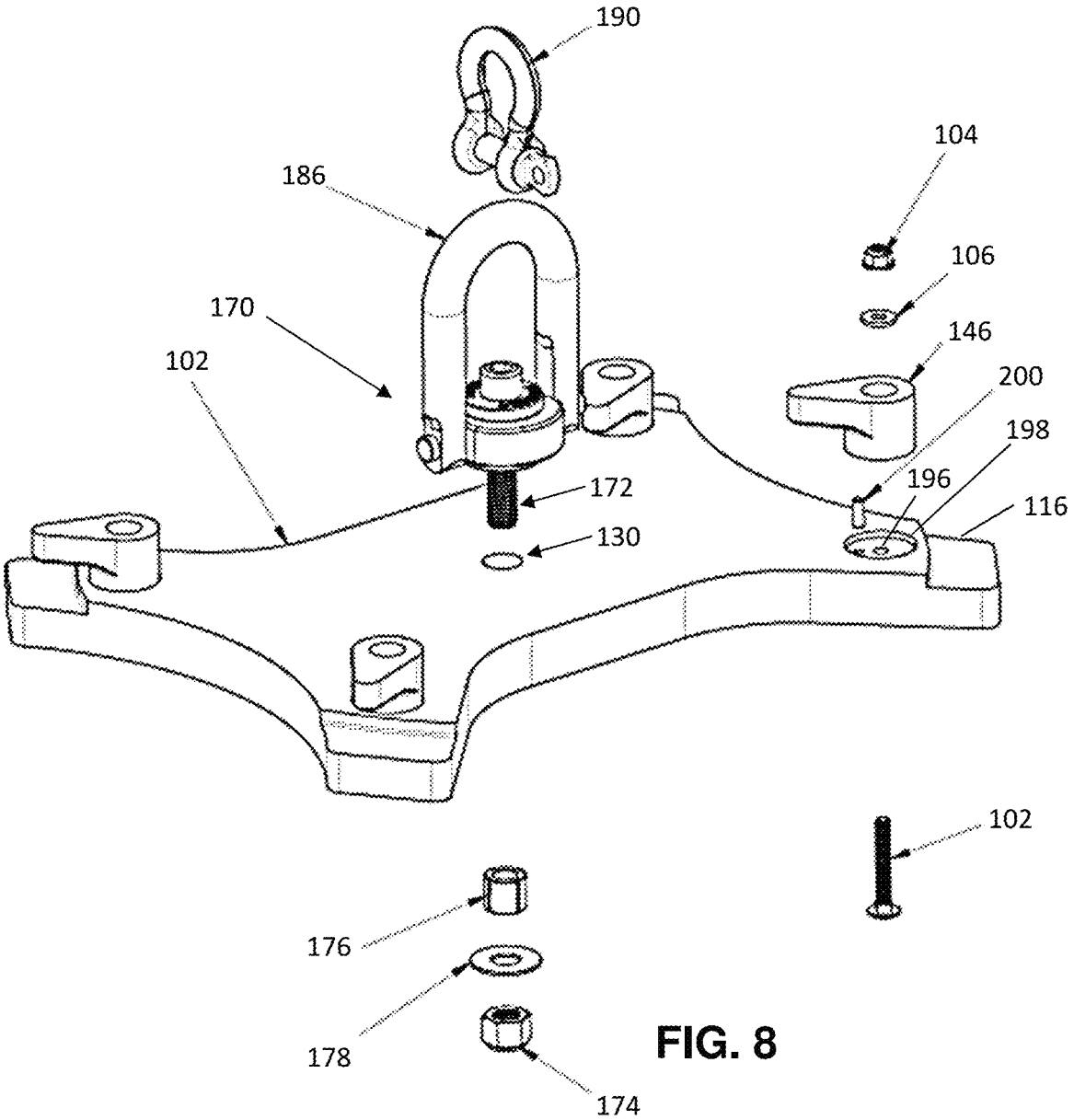
FIG. 8 is an exploded perspective view of the improved lifting apparatus of FIG. 1.

As shown in the exploded view of FIG. 8, a swivel device 170 is mounted on the plate 102 by a bolt 172. The threaded shank of the bolt passes through the hole 130 and is retained by a nut 174, which may have a nylon insert to lock the nut on the shank against loosening by vibration and use. An intermediate bushing 176, which may be for example stainless steel, and an annular washer 178, which may be for example stainless steel, increase material contact area and thereby strengthen the joint. The bushing is at least partially received in a counter bore 132 (FIG. 3) around the hole 130 in the bottom side of the plate 102.

As shown in FIG. 4, the swivel device has a rotatable collar 182 mounted on the bolt 172 (FIG. 8) above the plate 102. The collar can turn by rotation 184 around a vertical axis and may have bearings to permit smooth rotational for easy manipulation of a lifted fuel tank. A U-shaped link 186 is pivotally mounted on the collar 182 and can pivot by rotation 188 around a horizontal axis. The link thus can rotate and pivot to any orientation above the plate 102.

A shackle 190 can be attached and removed from the link 186 to connect the lifting apparatus 100 to hoisting tackle elements such as a master link 192 for lifting situations in which, for example, a hook is oversized relative to the link 186.

Figure 5:
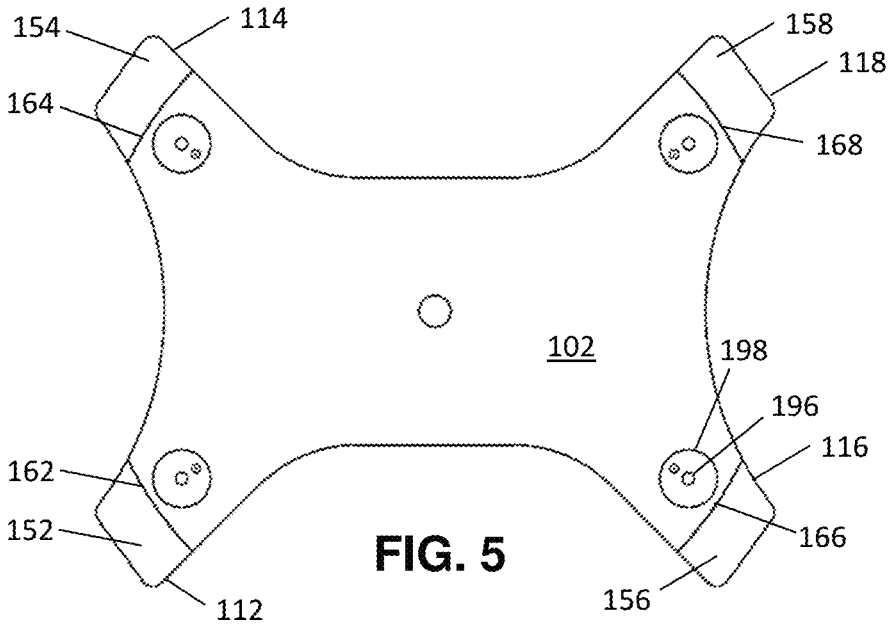
FIG. 5 is top view of the plate.
Figure 6:
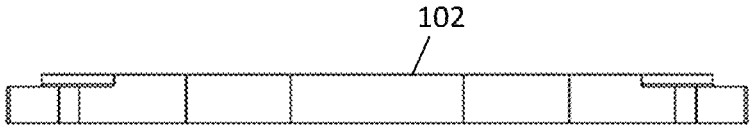
FIG. 6 is a side view of the plate.
Figure 7:
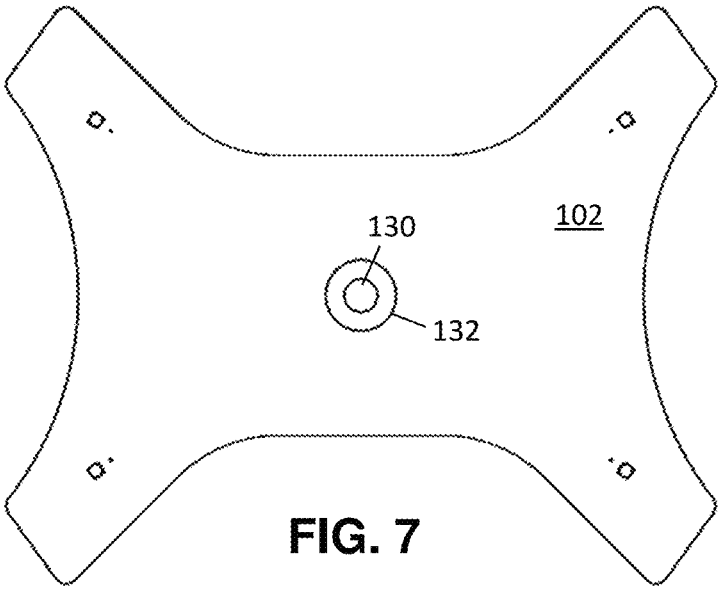
FIG. 7 is a bottom view of the plate.
Figure 9:
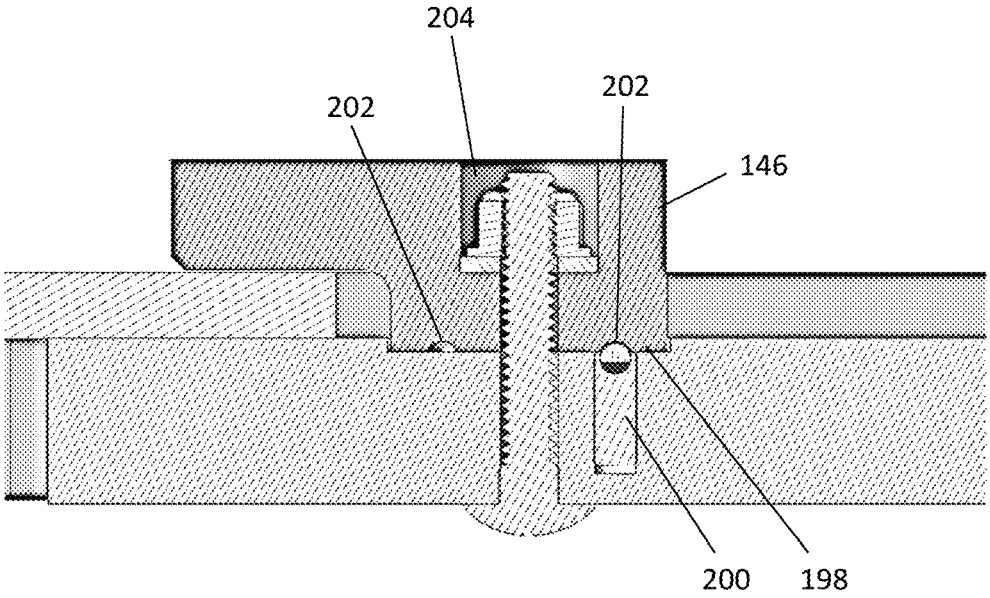
FIG. 9 is a cross-sectional view showing elements by which the clips are mounted on the arms of the plate.

As further shown in FIG. 8, each clip (see clip 146 and arm 116 in FIG. 8 as representative) is mounted on a respective arm by a bolt 102. The threaded shank of the bolt passes through a hole 196 through the arm and is retained by a nut 104, which may have a nylon insert to lock the nut on the shank against loosening by vibration and use. An annular washer 106, which may be for example stainless steel, is included between the head of the bolt and the clip. The top of the barrel portion of the clip may have a recess 204 as shown in FIG. 9 to sink or flush the washer and nut. An annular recess 198 (FIG. 5, FIG. 8) surrounds the hole 196 in the top side of the plate 102 to receive the bottom of the barrel portion of the clip.

A spring plunger 200 (FIGS. 8-9) has an upward biased bearing that registers with dimples 202 (FIG. 9) in the lower side of the barrel portion of the clip 146 (as representative of clips 142, 144 and 148 as well) to register the clip in the latched and unlatched positions. The body of the spring plunger is inserted into an upwardly opening partial hole in the floor of the recess 198. Thus, the clip snaps into the latched and unlatched positions and is maintained there by the spring plunger until rotated intentionally by hand by a user.

The support ring 50 is shown in the drawings as having a circular inner periphery 56 and an octagonal outer periphery for illustration purposes. Other support rings may have other types of inner and outer peripheries, including ovals and rectangles. Thus, the relative and absolute dimensions of the plate 102 can vary accordingly in various embodiments.

The plate 102 is shown in the drawings as having four arms 112, 114, 116, and 118 extending therefrom for illustration purposes. In embodiments, the plate 102 may have less or more additional arms extending therefrom. In some embodiments, the number of arms depends on the shape of the inner periphery 56 of the support ring 50 and/or the relative and absolute dimensions of the plate 102. Moreover, each arm 112-118 is shown in the drawings as carrying a respective clip 142-148 for illustration purposes. In certain embodiments, one or more of the arms might not have a respective clip so that the number of clips is less than the number of arms. Further, in various embodiments, it is foreseen that one or more of the clips 142-148 might be adjustably engageable from an unlatched to a latched position in a sliding manner, versus the rotatable actuation shown.

Particular embodiments and features have been described with reference to the drawings. It is to be understood that these descriptions are not limited to any single embodiment or any particular set of features, and that similar embodiments and features may arise, or modifications and additions may be made without departing from the scope of these descriptions and the spirit of the appended claims.

What is claimed is:

1. A lifting apparatus comprising:

a plate having multiple arms extending outward from a center thereof, each arm for engaging a respective portion of a support ring of a fuel tank; and multiple clips, each rotatably mounted on a respective arm, wherein the clips are each rotatable from an unlatched position to a latched position to secure the plate to the support ring of the fuel tank and wherein each clip snaps into the latched and unlatched positions and is maintained there by a spring plunger until rotated intentionally by a user's hand.

2. The lifting apparatus of claim 1, further comprising a swivel device rotatably mounted on the plate.

3. The lifting apparatus of claim 2, further comprising a link pivotably mounted on the swivel device.

4. The lifting apparatus of claim 1, wherein each arm comprises, at a distal end thereof, a ledge lowered from an upper surface of the plate, the ledge for contact engagement with a respective area of a bottom side of the support ring.

5. The lifting apparatus of claim 4, wherein each ledge is sunken or lowered from the upper surface of the plate by a respective shoulder, and wherein the ledges and shoulders register and stabilize engagement of the plate with the support ring.

6. The lifting apparatus of claim 5, wherein in full engagement with the support ring, each ledge contacts the bottom side of the support ring, and each shoulder abuts or approximately abuts an inner periphery of the support ring.

7. A lifting apparatus comprising:

a plate having multiple arms extending outward from a center thereof, each arm for engaging a respective portion of a support ring of a fuel tank; and multiple clips, each adjustably mounted on a respective arm, wherein the clips are each adjustably engageable from an unlatched position to a latched position to secure the plate to the support ring of the fuel tank, and wherein each clip snaps into the latched and unlatched positions and is maintained there by a spring plunger until rotated intentionally by a user's hand.

8. The lifting apparatus of claim 7, wherein each arm includes at least one clip mounted upon a surface thereof.

9. The lifting apparatus of claim 8, wherein each clip is mounted to an upper surface of a respective arm.

10. The lifting apparatus of claim 7, wherein at least one of the arms comprises, at a distal end thereof, a ledge lowered from an upper surface of the plate, the ledge for contact engagement with a respective area of a bottom side of the support ring.

11. The lifting apparatus of claim 7, wherein the plate further comprises multiple cutouts along a peripheral portion of the plate, each cutout being defined between two of the multiple arms.

* * * * *